US008264441B2

(12) United States Patent
Yamato et al.

(10) Patent No.: US 8,264,441 B2
(45) **Date of Patent: *Sep. 11, 2012**

(54) METHOD FOR DRIVING LIQUID CRYSTAL DISPLAY APPARATUS

(75) Inventors: Asahi Yamato, Tokyo (JP); Yuki Kawashima, Koshigaya (JP); Kiyoshi Nakagawa, Yokohama (JP); Kohzoh Takahashi, Tokyo (JP); Toshihiro Yanagi, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 695 days.

This patent is subject to a terminal disclaimer.

(21) Appl. No.: 11/886,958

(22) PCT Filed: Feb. 2, 2006

(86) PCT No.: PCT/JP2006/301801

§ 371 (c)(1),
(2), (4) Date: Sep. 24, 2007

(87) PCT Pub. No.: WO2006/112108

PCT Pub. Date: Oct. 26, 2006

(65) Prior Publication Data

US 2009/0079682 A1 Mar. 26, 2009

(30) Foreign Application Priority Data

Mar. 31, 2005 (JP) ..... 2005-104833

(51) Int. Cl.
*G09G 3/36* (2006.01)

(52) U.S. Cl. ..... 345/94; 345/89; 345/690

(58) Field of Classification Search ..... 345/87–102, 345/204, 690–699

See application file for complete search history.

(56) References Cited

U.S. PATENT DOCUMENTS

| | | | | |
|---|---|---|---|---|
| 5,034,986 | A | 7/1991 | Karmann et al. | |
| 5,465,102 | A | 11/1995 | Usui et al. | |
| 6,496,194 | B1 | 12/2002 | Mikoshiba et al. | |
| 6,661,488 | B1 | 12/2003 | Takeda et al. | |
| 7,113,227 | B1 | 9/2006 | Kakuya et al. | |
| 2001/0033691 | A1 | 10/2001 | Kimura | |
| 2002/0011979 | A1* | 1/2002 | Nitta et al. | 345/89 |
| 2002/0011998 | A1* | 1/2002 | Tamura | 345/204 |
| 2002/0021395 | A1 | 2/2002 | Koma et al. | |
| 2002/0036717 | A1 | 3/2002 | Abiko et al. | |

(Continued)

FOREIGN PATENT DOCUMENTS

EP 0 662 767 12/1995

(Continued)

OTHER PUBLICATIONS

International Search Report dated Apr. 18, 2006.

(Continued)

*Primary Examiner* — Stephen Sherman
(74) *Attorney, Agent, or Firm* — Harness, Dickey & Pierce, P.L.C.

(57) ABSTRACT

In one embodiment of the present invention, when a still image is displayed, applied voltages respectively corresponding to a total of n (n being an integer of not less than 4) types of gradation 0 to (n−1) are outputted to pixels. On the other hand, when a moving image is displayed, an applied voltage corresponding to a predetermined gradation m ($1 \leqq m \leqq (n-2)$) is applied to the pixels instead of applied voltages respectively corresponding to gradations of less than the predetermined gradation m.

12 Claims, 10 Drawing Sheets

U.S. PATENT DOCUMENTS

| | | | | |
|---|---|---|---|---|
| 2002/0140658 | A1 | 10/2002 | Takatori | |
| 2002/0190940 | A1* | 12/2002 | Itoh et al. | 345/87 |
| 2003/0142055 | A1 | 7/2003 | Iisaka | |
| 2004/0183820 | A1 | 9/2004 | Kawahara et al. | |
| 2004/0201564 | A1 | 10/2004 | Sugino et al. | |
| 2004/0263495 | A1 | 12/2004 | Sugino et al. | |
| 2005/0024546 | A1 | 2/2005 | Kubo et al. | |
| 2005/0162360 | A1 | 7/2005 | Ishihara et al. | |
| 2005/0225522 | A1 | 10/2005 | Wu et al. | |
| 2005/0248524 | A1 | 11/2005 | Feng et al. | |
| 2006/0017678 | A1* | 1/2006 | Shiomi | 345/89 |
| 2006/0028419 | A1 | 2/2006 | Lee et al. | |

FOREIGN PATENT DOCUMENTS

| | | |
|---|---|---|
| JP | 09-106262 | 4/1997 |
| JP | 10-097227 | 4/1998 |
| JP | 11-045078 | 2/1999 |
| JP | 11-109391 | 4/1999 |
| JP | 11-258605 | 9/1999 |
| JP | 2000-221475 | 8/2000 |
| JP | 2000-330542 | 11/2000 |
| JP | 2001-175237 | 6/2001 |
| JP | 2002-072169 | 3/2002 |
| JP | 2002-131721 | 5/2002 |
| JP | 2003-186446 | 7/2003 |
| JP | 2003-207762 | 7/2003 |
| JP | 2004-078129 | 3/2004 |
| JP | 2004-334010 | 11/2004 |
| JP | 2005-070799 | 3/2005 |
| TW | 548477 | 8/2003 |
| TW | 550412 | 9/2003 |
| WO | WO 03/077013 | 9/2003 |
| WO | WO 2006/112110 | 10/2006 |

OTHER PUBLICATIONS

U.S. Office Action dated May 2, 2011.
U.S. Office Action dated Jul. 9, 2010 corresponding to co-pending U.S. Appl. No. 11/887,220.
U.S. Office Action dated Sep. 2, 2010 corresponding to co-pending U.S. Appl. No. 11/887,220.
U.S. Office Action dated Jan. 6, 2011 corresponding to co-pending U.S. Appl. No. 11/887,220.
U.S. Office Action dated Jul. 9, 2010.
U.S. Office Action dated Sep. 2, 2010.
U.S. Office Action dated Jan. 6, 2011.
U.S. Advisory Action dated Aug. 23, 2011 for U.S. Appl. No. 11/887,220.
U.S. Notice of Allowance dated Oct. 13, 2010 for U.S. Appl. No. 11/183,994.
U.S. Notice of Panel Decision dated Sep. 28, 2009 for U.S. Appl. No. 11/183,994.
U.S. Advisory Action dated Jul. 29, 2009 for U.S. Appl. No. 11/183,994.
U.S. Office Action dated May 12, 2009 for U.S. Appl. No. 11/183,994.
U.S. Office Action dated Oct. 15, 2008 for U.S. Appl. No. 11/183,994.
U.S. Office Action dated Oct. 18, 2011 for U.S. Appl. No. 11/887,220.
U.S. Notice of Allowance mailed Mar. 5, 2012 for copending U.S. Appl. No. 11/887,220.
U.S. Office Action mailed Feb. 3, 2012 for copending U.S. Appl. No. 11/887,220.

* cited by examiner

Conventional Art

Conventional Art

Conventional Art

METHOD FOR DRIVING LIQUID CRYSTAL DISPLAY APPARATUS

TECHNICAL FIELD

The present invention relates to methods for driving liquid crystal display apparatuses. Particularly, the present invention relates to a method for driving a liquid crystal display apparatus, which method makes it possible to achieve an improvement in response speed at which a moving image is displayed.

BACKGROUND ART

Conventionally, a liquid crystal display apparatus has had a problem of low response speed. That is, a change in display gradation of the liquid crystal display apparatus is such that: a change in orientation state of liquid crystal molecules is made by making a change in voltage applied to a liquid crystal layer, so that the transmittance of a display pixel is changed. Moreover, the low response speed of the liquid crystal display apparatus is attributed to the fact that it takes a long time to complete the change caused in orientation state of the liquid crystal molecules in response to the change in voltage applied to the liquid crystal layer.

In recent years, liquid crystal display apparatuses such as liquid crystal televisions, portable televisions, and portable game machines have had increased opportunities to display high-definition moving images with liquid crystals, and therefore have been increasingly required to respond at high speeds. On the other hand, high-quality picture technologies often cause a decrease in response speed simultaneously (e.g., AVS and mobile AVS).

As disclosed in Japanese Unexamined Patent Application Publication No. 78129/2004 (Tokukai 2004-78129; published on Mar. 11, 2004), a known example of a method for attempting to improve response speed is a method for emphasizing a transitional gradation by performing overshoot driving. That is, as shown in FIG. 9, the overshoot driving is such that when the initial luminance A of the initial gradation 0 is changed to the target luminance C of the target gradation 64, a voltage corresponding to the excessive luminance B, which is higher than the target luminance C, is initially applied to the liquid crystals only for a short time. This causes a high voltage to be applied to the liquid crystals, thereby making it possible to reduce the response time it takes to attain the target luminance C.

However, as shown in FIG. 9, such a method causes deterioration in image quality. Examples of such deterioration in image quality include a so-called angular response (two-step response) which, before the target luminance C is attained, emerges as a sharp corner indicating the excessive luminance B, which is higher than the target luminance C. The presence of such a corner indicating a luminance higher than the target luminance C causes an image to instantaneously look whitish. Since this is very conspicuously identified, it is necessary that the driving be performed so that no such corner emerges.

However, a change in overdrive amount only causes a change in size of the left angular portion, and does not result in an improvement in the right sloping portion. Therefore, there is no improvement in display. Further, as described above, an excessive overdrive amount causes a strikingly white display to be produced at the angular portion, thereby causing deterioration in display quality.

Furthermore, even when the overshoot driving is performed, a sufficient speed may not be able to be obtained in a low-gradation region due to the aforementioned low response speed.

That is, the aforementioned low response speed of a liquid crystal display apparatus is not seen uniformly all over the gradation-level regions, but is such that the response speed becomes extremely low in part of the gradation regions. For example, the response speed of a vertically-aligned and normally black liquid crystal display apparatus (mobile ASV) is extremely low at a rising edge from a low gradation (black display) to an intermediate gradation. Further, the response speed of a normally white liquid crystal display apparatus (mobile ASV) is extremely low in a transition from a high gradation (white display) to an intermediate gradation. These low response speeds cause display problems such as residual images.

Specifically, in the normally white liquid crystal display apparatus, as shown in FIG. 10, the response time during which initial gradations are changed to attained gradations is especially long in a transition from the initial gradation values 255 to 224 to the attained gradation values 255 to 224 or to the attained gradation values 224 to 192.

Specifically, in the normally black liquid crystal display apparatus, as shown in FIG. 11, the response time during which initial gradations are changed to attained gradations is especially long in a transition from the initial gradation values 0 to 32 to the attained gradation values 32 to 64 or to the attained gradation values 64 to 94.

In view of this, for example, Japanese Unexamined Patent Application Publication No. 131721/2002 (Tokukai 2002-131721; published on May 9, 2002) discloses a method for improving response speed by carrying out a display without using a gradation level at which the response speed becomes low. Note that a voltage so applied to liquid crystals to be used for driving a liquid crystal display apparatus is usually represented by a gradation-luminance curve shown in FIG. 12.

However, according to the conventional method of Tokukai 2002-131721 for driving a liquid crystal display apparatus, the initial voltage is increased by a predetermined voltage when a gradation level at which the response speed becomes low is not used. Therefore, when a still image is displayed, it is impossible to use a normal luminance characteristic represented by the gradation-luminance curve of FIG. 12.

The present invention has been made in view of the foregoing problems, and it is an object of the present invention to provide a method for driving a liquid crystal display apparatus, which method makes it possible to prevent deterioration in display quality of both a still image and a moving image and to achieve an improvement in response speed at which a moving image is displayed.

DISCLOSURE OF INVENTION

In order to solve the foregoing problems, a method of the present invention for driving a liquid crystal display apparatus includes the steps of: when a still image is displayed, outputting applied voltages to pixels, the applied voltages respectively corresponding to a total of n (n being an integer of not less than 4) types of gradation 0 to (n−1); and when a moving image is displayed, outputting an applied voltage to the pixels instead of applied voltages respectively corresponding to gradations of less than a predetermined gradation m ($1 \leqq m \leqq (n-2)$), the applied voltage corresponding to the predetermined gradation m.

According to the foregoing invention, normal gradations can be displayed when a still image is displayed. On the other hand, when a moving image is displayed, an applied voltage corresponding to a predetermined gradation m ($1 \leqq m \leqq (n-2)$) is applied to pixels instead of applied voltages respectively corresponding to gradations of less than the predetermined gradation. Therefore, the applied voltages respectively corresponding to the gradations of less than the predetermined gradation m are not used. This makes it possible to achieve an improvement in response speed.

Furthermore, since the applied voltages respectively corresponding to the gradations of less than the predetermined gradation m are not used, it is possible to prevent a so-called angular response, for example, in cases where overdrive driving is performed.

This makes it possible to provide a method for driving a liquid crystal display apparatus, which method makes it possible to prevent deterioration in display quality of both a still image and a moving image and to achieve an improvement in response speed at which a moving image is displayed.

Further, according to the method, it is preferable that the liquid crystal display apparatus employs a normally black system.

With this, since the response speed of a normally black system is low in a low-gradation region, the response speed can be improved.

In order to solve the foregoing problems, a method of the present invention for driving a liquid crystal display apparatus includes the steps of: when a still image is displayed, outputting applied voltages to pixels, the applied voltages respectively corresponding to a total of n (n being an integer of not less than 4) types of gradation 0 to (n−1); and when a moving image is displayed, outputting an applied voltage to the pixels instead of applied voltages respectively corresponding to gradations of not less than a predetermined gradation q ($1 \leqq q \leqq (n-1)$), the applied voltage corresponding to a predetermined gradation q−1.

Further, according to the method, it is preferable that the liquid crystal display apparatus employs a normally white system.

All this makes it possible to provide a method for driving a liquid crystal display apparatus, regardless of whether the liquid crystal display apparatus employs a normally black system or a normally white system, which method makes it possible to prevent deterioration in display quality of both a still image and a moving image and to achieve an improvement in response speed at which a moving image is displayed.

Further, according to the method of the present embodiment for driving the liquid crystal display apparatus 10, it is preferable to discriminate between a still image and a moving image in accordance with a signal for discriminating between a still image and a moving image.

This makes it possible to provide a method for driving a liquid crystal display apparatus 10, which method makes it easy to discriminate between a still image and a moving image by acquiring a signal for discriminating between a still image and a moving image. When a still image is displayed, this method makes it possible to perform normal driving for all gradations, thereby making it possible to display the still image without impairing γ characteristic, luminance, and contrast. When a moving image is displayed, this method makes it possible to achieve an improvement in response speed.

Additional objects, features, and strengths of the present invention will be made clear by the description below. Further, the advantages of the present invention will be evident from the following explanation in reference to the drawings.

BRIEF DESCRIPTION OF DRAWINGS

FIG. 5(*b*) is a waveform chart showing a liquid-crystal response waveform obtained from FIG. 5(*a*).

BEST MODE FOR CARRYING OUT THE INVENTION

An embodiment of the present invention will be described below with reference to FIGS. 1 to 8.

Figure 2:
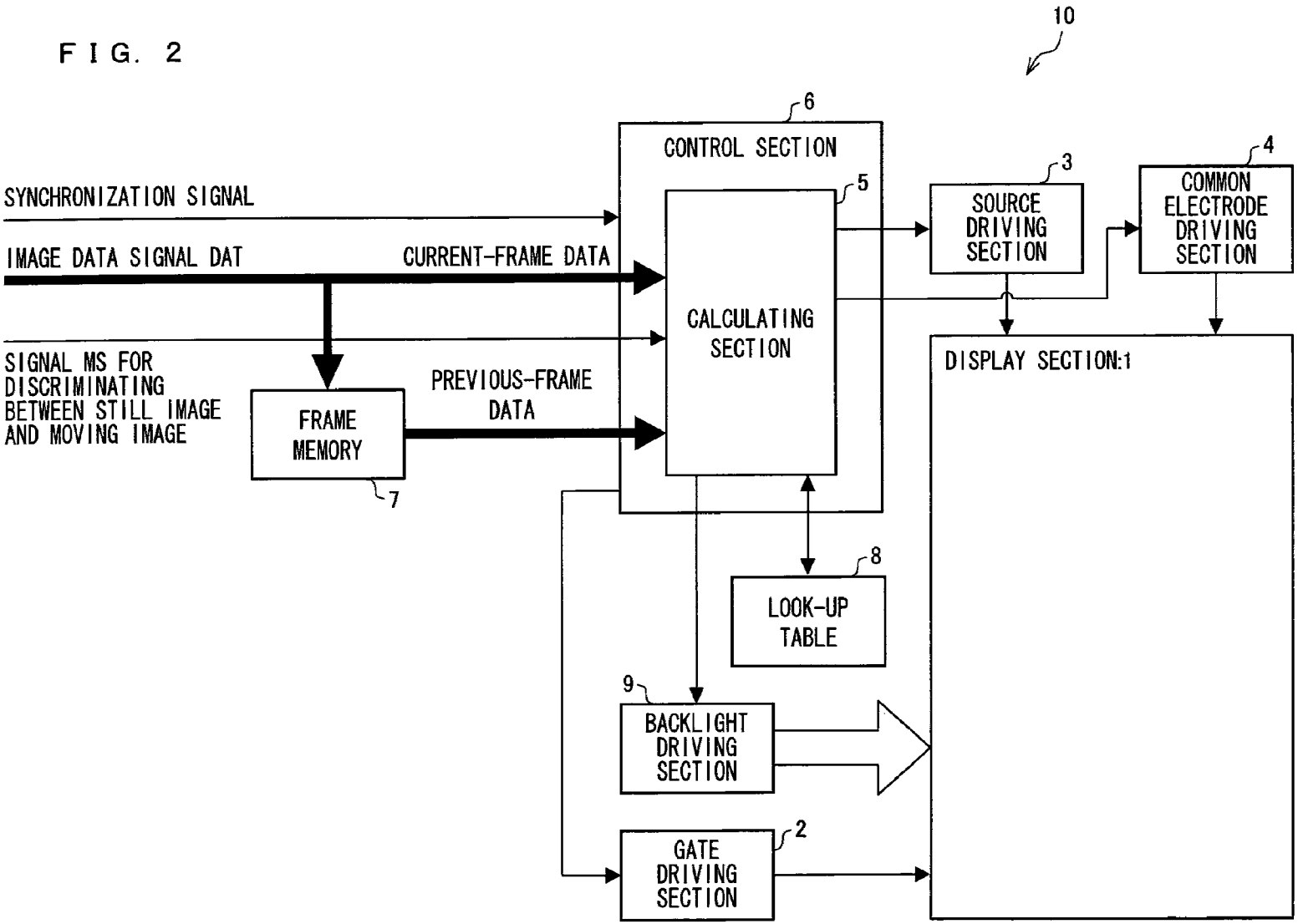
FIG. 2 is a block diagram showing an overall arrangement of the liquid crystal display apparatus.
Figure 3:
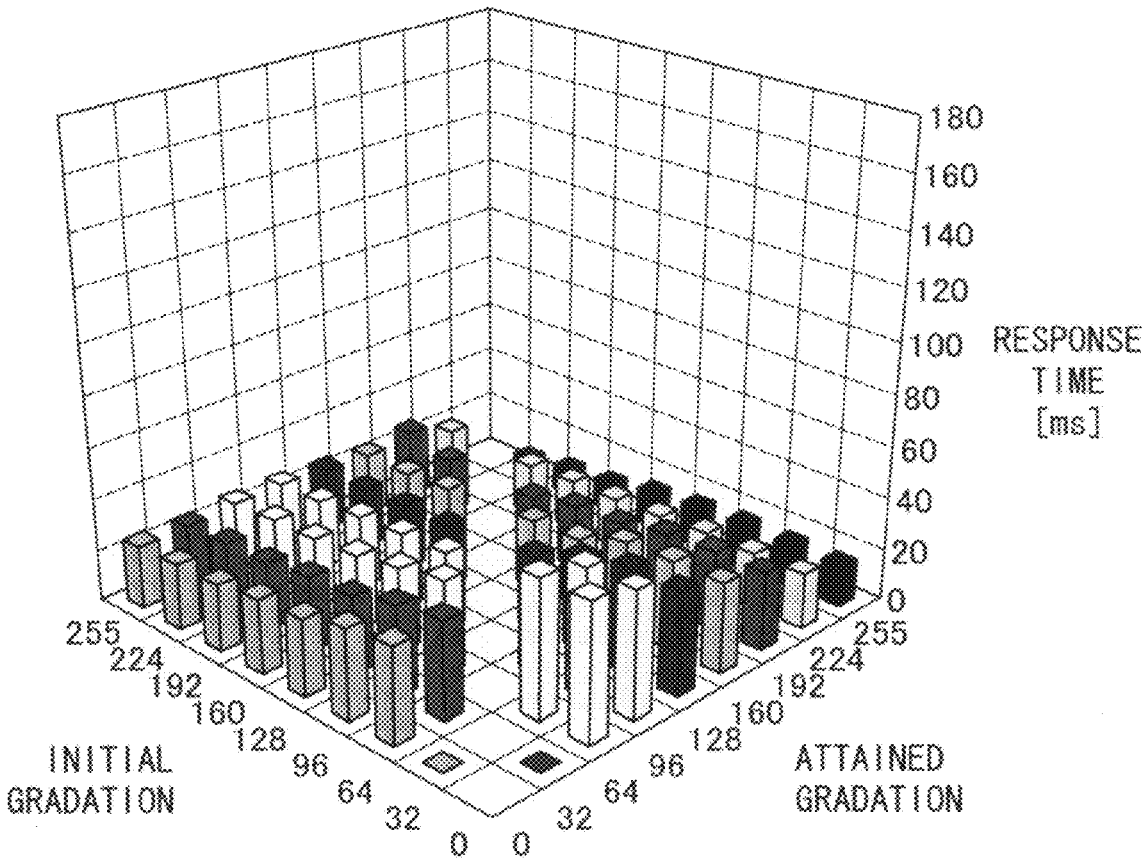
FIG. 3 is a three-dimensional graph showing a (V0 to V31→V32) response speed characteristic exhibited when a low-gradation region is eliminated at the time of displaying a moving image in the liquid crystal display apparatus according to a normally black system.

For example, as shown in FIG. 2, an active matrix liquid crystal display apparatus 10 of the present embodiment includes: a display section 1, a gate driving section 2, a source driving section 3, a common electrode driving section 4, a control section in which a calculating section 5 is provided, a frame memory 7, a look-up table 8, and a backlight driving section 9.

Although not fully shown in the figure, the display section 1 includes e scanning signal lines that are parallel to one another, f data signal lines that are parallel to one another, and pixels arrayed in a matrix manner. Each of the pixels is formed in a region enclosed by two adjacent scanning signal lines and two adjacent data signal lines.

The gate driving section 2 sequentially generates, in accordance with a gate clock signal and a gate start pulse each outputted from the control section 6, scanning signals that are to be supplied to scanning signal lines connected to pixels arrayed in each line.

The source driving section 3 samples an image data signal DAT in accordance with a source clock signal and a source start pulse each outputted from the control section 6, and outputs the obtained image data to data signal lines connected to pixels arrayed in each line.

The control section 6 is a circuit that generates, in accordance with a synchronization signal inputted thereto, the image data signal DAT, and a signal MS for discriminating between an moving image and a still image, various control signals for controlling operation of the gate driving section 2 and source driving section 3, and then outputs the control signals. As described above, examples of the control signals that are outputted from the control section 6 include the clock signal, the start pulse, and the image data signal DAT.

The calculating section 5 of the control section 6 converts the image data signal DAT when a moving image is displayed. The data conversion in the calculating section 5 is performed, for example, in accordance with data stored in the look-up table 8. Note that the calculating section 5 can be integrated with a driver such as the source driving section 3 or the gate driving section 2. Further, in cases where an external control IC is provided, the calculation section 5 can also be part of that control IC. Furthermore, the calculating section 5 can also be incorporated as a monolithic circuit into the display section 1. Further, according to the foregoing example, the calculating section 5 is provided in the control section 6. However, the present invention is not limited to this. It is also possible to perform a gradation process or the after-mentioned black process by disposing only the calculating section 5 in front of the control section 6.

On this occasion, the control section 6 receives a signal MS for discriminating between a moving image and a still image, thereby determining whether or not a moving image is displayed. In case of a still image, the control section 6 becomes able to carry out a display without making a gradation transition, and therefore becomes able to carry out a display without impairing γ characteristic, luminance, and contrast at all.

Such a signal MS for discriminating between a moving image and a still image can be realized, for example, by preparing a single terminal for an input signal in such a way that a high input signal indicates a moving image and a low input signal indicates a still image. That is, for example, it is possible that: the control section 6 receives, from a user set, a 1-bit signal that represents a moving image or a still image, thereby discriminating between a moving image and a still image.

Note that the discrimination between a moving image and a still image is not necessarily limited to this. For example, a command that represents a moving image or a still image may be received. Furthermore, it is possible to employ a discriminating method including the steps of: storing, in the frame memory 7, data corresponding to the previous frame that came immediately before the current frame; comparing the data with data corresponding to the current frame; and setting a moving-image mode when there is a difference between the data corresponding to the previous frame and the data corresponding to the current frame. Examples of the difference between the data corresponding to the previous frame and the data corresponding to the current frame include a difference of not less than a predetermined gradation and a difference of not less than a certain number of pixels.

Meanwhile, each of the pixels of the display section 1 includes a switching element such as a TFT (thin film transistor), a liquid crystal capacitor, and the like. In such a pixel, the TFT has a gate connected to a scanning signal line and has a drain and source via both of which one electrode of the liquid crystal capacitor is connected to a data signal line, and the other electrode of the liquid crystal capacitor is connected to a common electrode wire that is common to all the pixels. The common electrode driving section 4 supplies a voltage that is to be applied to this common electrode wire.

In the liquid crystal display apparatus 10, the gate driving section 2 selects a scanning signal line, and an image data signal DAT to be sent to a pixel corresponding to a combination of the scanning signal line being selected and each of the data signal lines is outputted to that data signal line by the source driving section 3. With this, the image data are respectively written in pixels connected to the scanning signal line. Similarly, the gate driving section 2 sequentially selects the scanning signal lines, and the source driving section 3 outputs image data to the data signal lines. As a result, the image data are respectively written in all the pixels of the display section 1, so that the display section 1 displays an image corresponding to the image data signal DAT.

On this occasion, the image data that are sent from the control section 6 to the source driving section are transmitted as an image data signal DAT in a time-dividing manner. When the image data are sent to the source driving section 3 via the control section 6, the current-frame data is stored in the frame memory 7. The one-frame data stored in the frame memory 7 is used to be compared with the previous-frame data when the calculating section 5 performs overdrive driving.

The source driving section 3 extracts various image data from the image data signal DAT at timings based on a source clock signal, an inversion source clock signal, and a source start pulse each serving as a timing signal, and then outputs the image data to the respective pixels.

Incidentally, for example, it is known that the response speed of a normally black system becomes low in a transition from a low gradation to a higher gradation. This causes a problem when a moving image is displayed. The response speed becomes low especially when both of the gradations (i.e., the gradation before change and the gradation after change) are at low levels. On the other hand, it is known that the response speed of a normally white system becomes low in a transition from a high gradation to a lower gradation or especially when both of the gradations are at high levels.

In view of this, the present embodiment achieves an improvement in response speed by displaying a still image in accordance with a conventional normal gradation-luminance curve shown in FIG. 14 and displaying a moving image without using a level at which the response speed becomes low.

Specifically, assume, for example, that when the total number of gradations is 256, a normally black system is slow in responding to applied voltages 0V to 31V respectively corresponding to gradations 0 to 31. In this case, the applied voltages V0 to V31 respectively corresponding to the 32 gradations are raised to the same voltage as an applied voltage V32 corresponding to a gradation 32.

Figure 1:
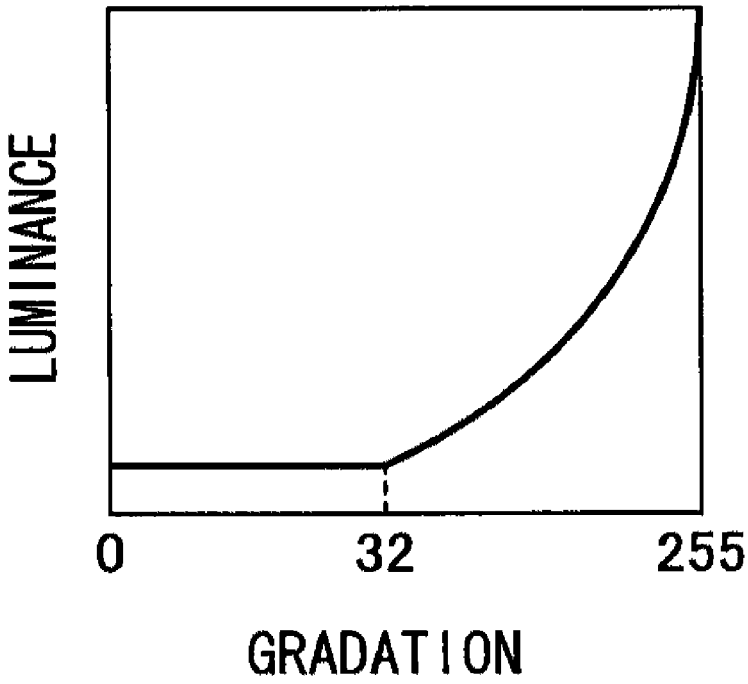
FIG. 1 shows an embodiment of a method of the present invention for driving a liquid crystal display apparatus, and is a characteristic diagram showing a gradation-luminance relationship formed when a low-gradation region is eliminated at the time of displaying a moving image.
Figure 11:
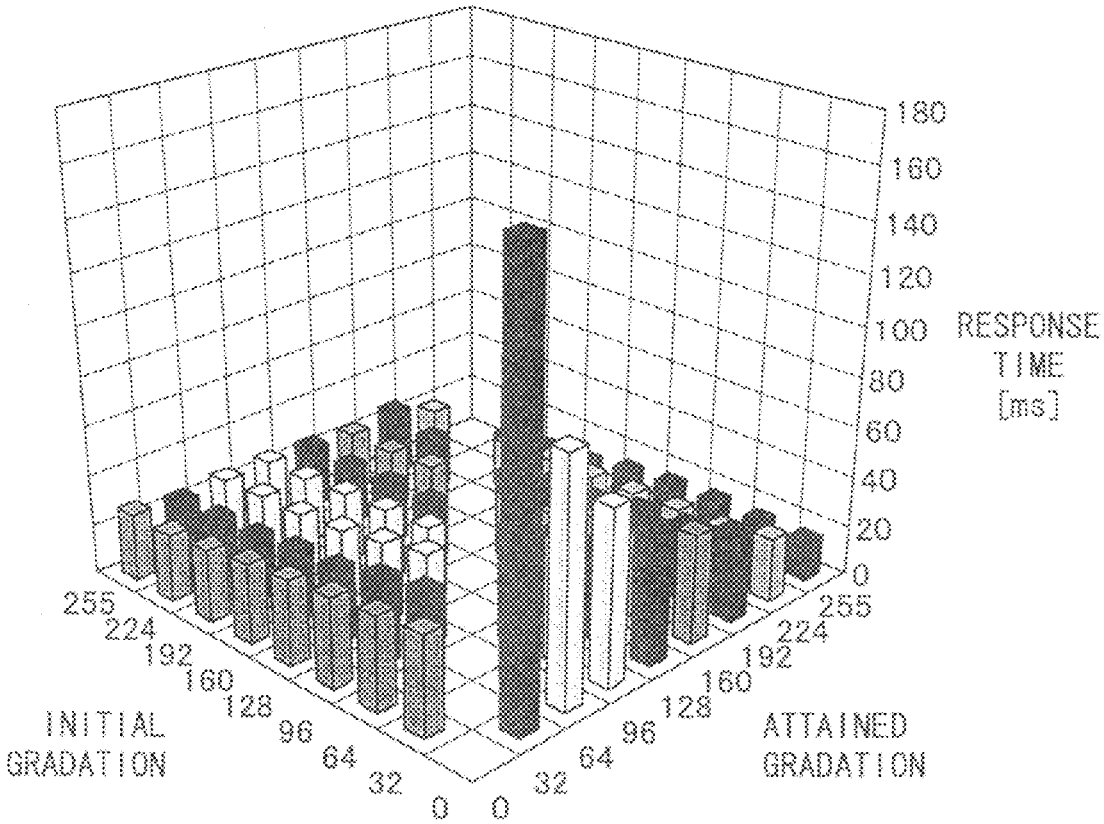
FIG. 11 is a three-dimensional graph showing a response speed characteristic exhibited when the liquid crystal display apparatus displays a moving image according to a normally black system.
Figure 12:
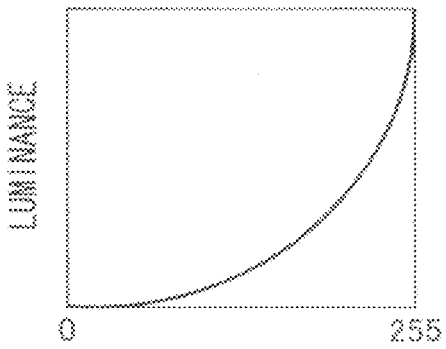
Conventional Art FIG. 12
FIG. 12 is a characteristic diagram showing a normal gradation-luminance relationship of the liquid crystal display apparatus.

This results in such a gradation-luminance relationship as shown in FIG. 1. Further, a comparison between FIG. 3 and FIG. 11 of the conventional technique shows that the response speed is improved in a transition from the initial gradation values 0 to 32 to the attained gradation values 32 to 64 or to the attained gradation values 64 to 94.

Figure 4:
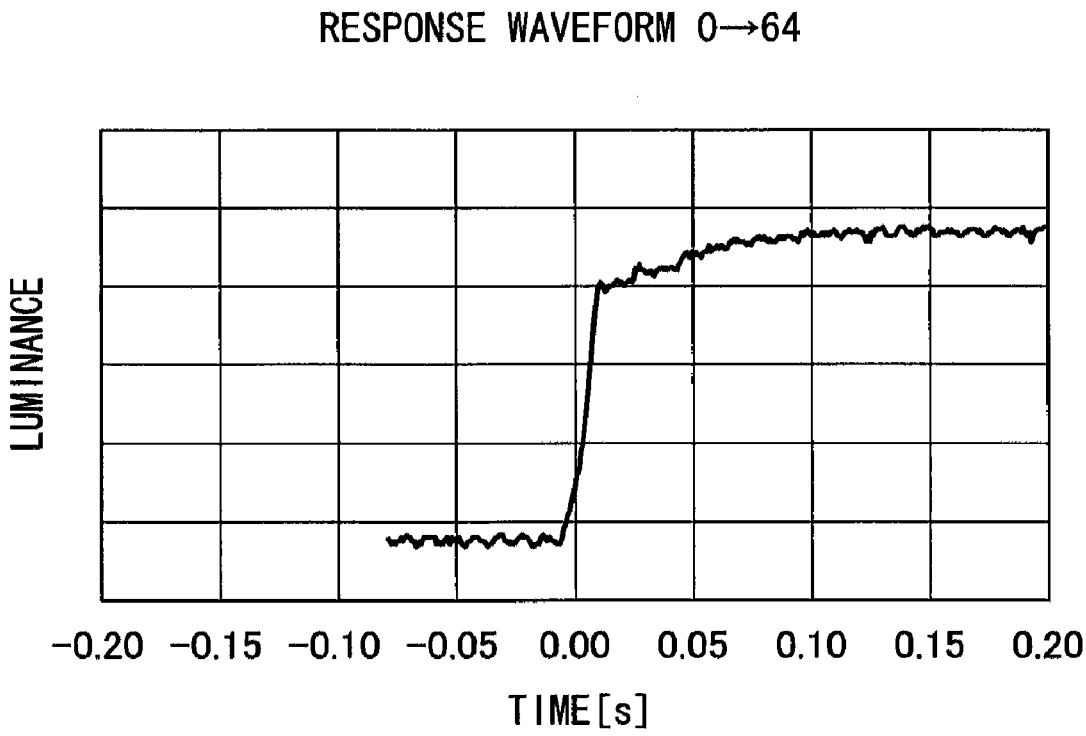
FIG. 4 is a waveform chart showing a response waveform obtained when a low-gradation region is eliminated at the time of displaying a moving image in the liquid crystal display apparatus and of performing overdrive driving.

In addition, for example, the performance of overdrive driving makes it possible to, as shown in FIG. 4, achieve a very satisfactory improvement in response speed at which a moving image is displayed. Further, since the other gradation applied voltages (V32 to V255) are not changed, the y characteristic of the display section 1 is not changed, so that it is possible to maintain a good display.

Figure 5:
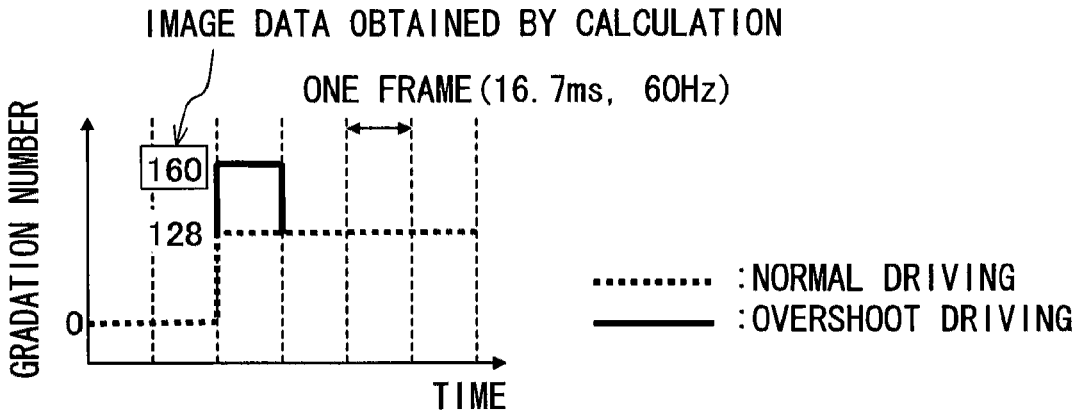
FIG. 5(*a*) is a diagram showing a relationship between time and gradation data that are to be written in pixels when overdrive driving is performed such that the gradation 0 (black) in the previous frame is changed to a gradation 128 (intermediate gradation) for the current frame.
Figure 5:
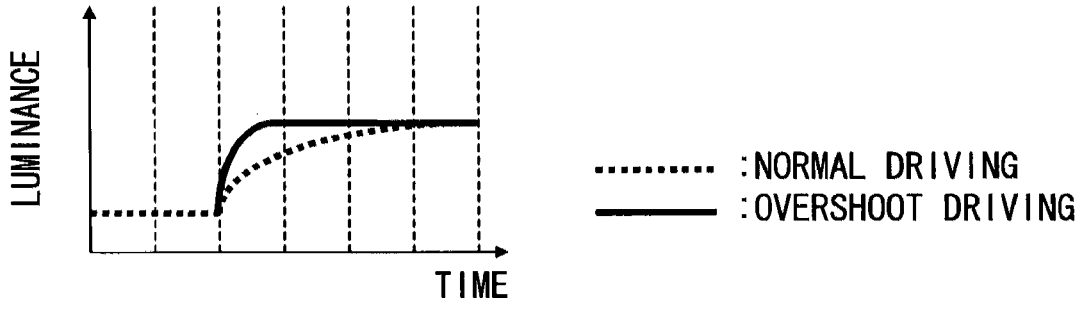

The following explains overdrive driving. As shown in FIG. 5(*a*), the overdrive driving is a driving method of applying correction data derived from a relationship formed by making a comparison between data corresponding to the current frame and data corresponding to the one frame that came immediately before the current frame. To be more accurate, the relationship refers to "to apply such a gradation as to make a difference bigger than the difference between the gradation of the one frame that came immediately before the current frame (such a frame being hereinafter referred to as 'previous frame') and the gradation of data inputted to the current frame". For example, the overdrive driving is such driving that in cases where the gradation of the previous frame is V0 and the gradation of data inputted to the current frame is V128, the gradation V160 is applied. The application of such a gradation value makes it possible to obtain a liquid-crystal response waveform, shown in FIG. 5(*b*), which has a sharp rising edge.

As described above, the overdrive driving is a driving method of applying an unusual voltage only to a frame that comes immediately after a change in gradation. Further, the amount of change in voltage is changed in accordance with the relationship between a gradation before change and a gradation after change. Therefore, the luminance at a gradation is not steadily changed to a certain value.

Figure 6:
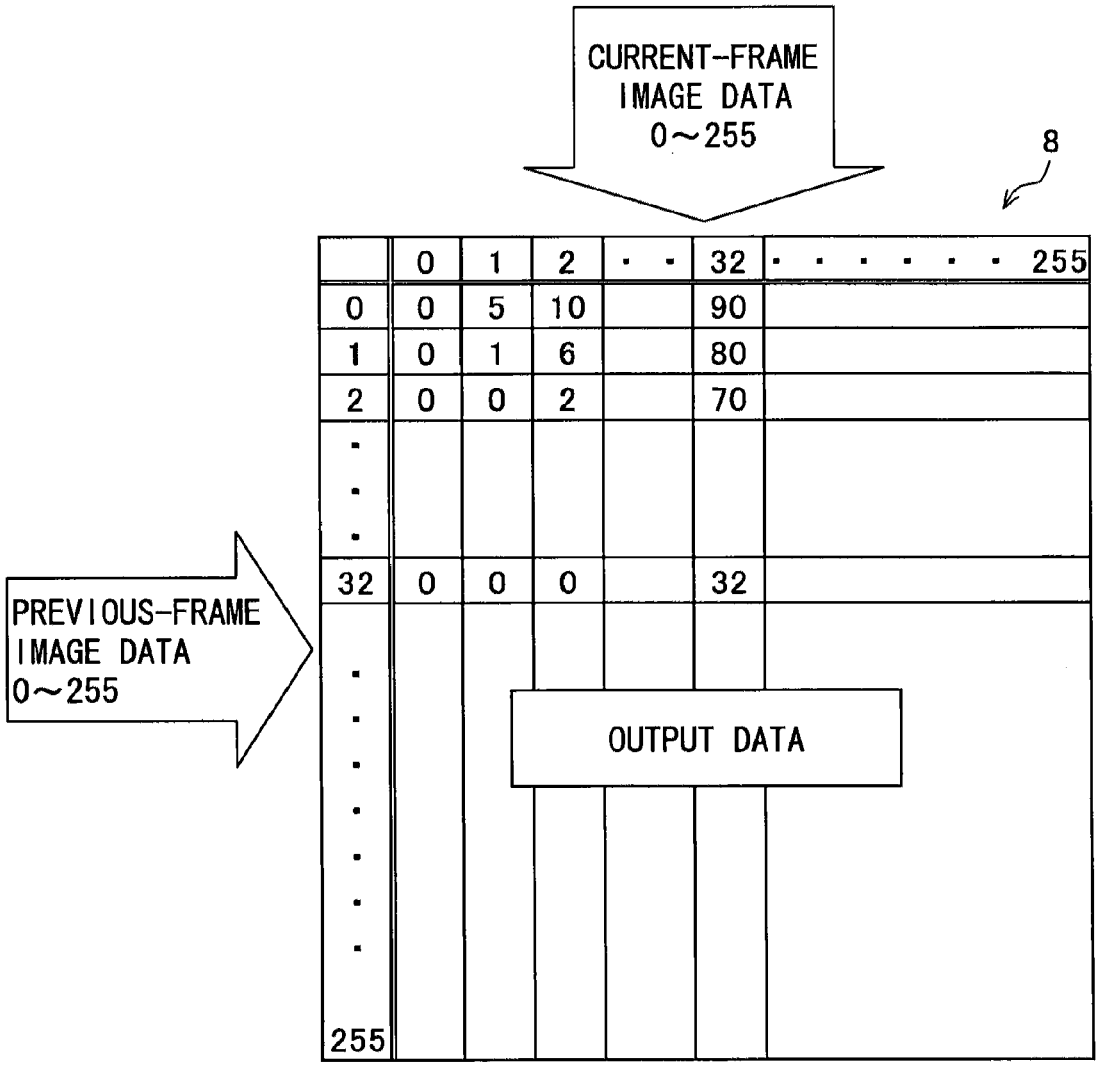
FIG. 6 is a diagram showing a look-up table, in which overdrive driving output data are stored in correspondence with the gradation values of previous-frame image data and the gradation values of current-frame image data, of the liquid crystal display apparatus.

A gradation value for applying a voltage higher than a normally desired gradation applied voltage for the purpose of the overdrive driving, i.e., a gradation value that is found in accordance with the relationship between a gradation before change and a gradation after change can be obtained by calculation. However, the present invention is not necessarily limited to this. As shown in FIG. 6, such a gradation value can be calculated with use of the look-up table 8.

Note that although the present embodiment performs overdrive driving, the present invention does not necessarily perform overdrive driving.

Further, although the foregoing explanation assumes that a normally black system is employed, the present invention is not necessarily limited to this. A normally white system can also be employed in the same line of thought.

That is, it is known that the response speed of a normally white system becomes low in a transition from a high gradation to a lower gradation or especially when both of the gradations are at high levels. This causes a problem when a moving image is displayed.

Therefore, the response speed can be improved by carrying out a display without using a level at which the response speed becomes low.

Figure 7:
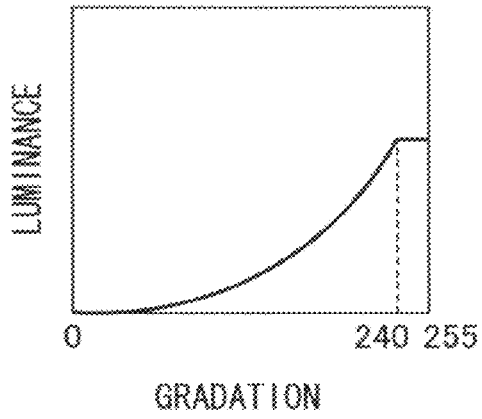
FIG. 7 is a characteristic diagram showing a gradation-luminance relationship formed when a high-gradation region is eliminated at the time of displaying a moving image in the liquid crystal display apparatus.
Figure 8:
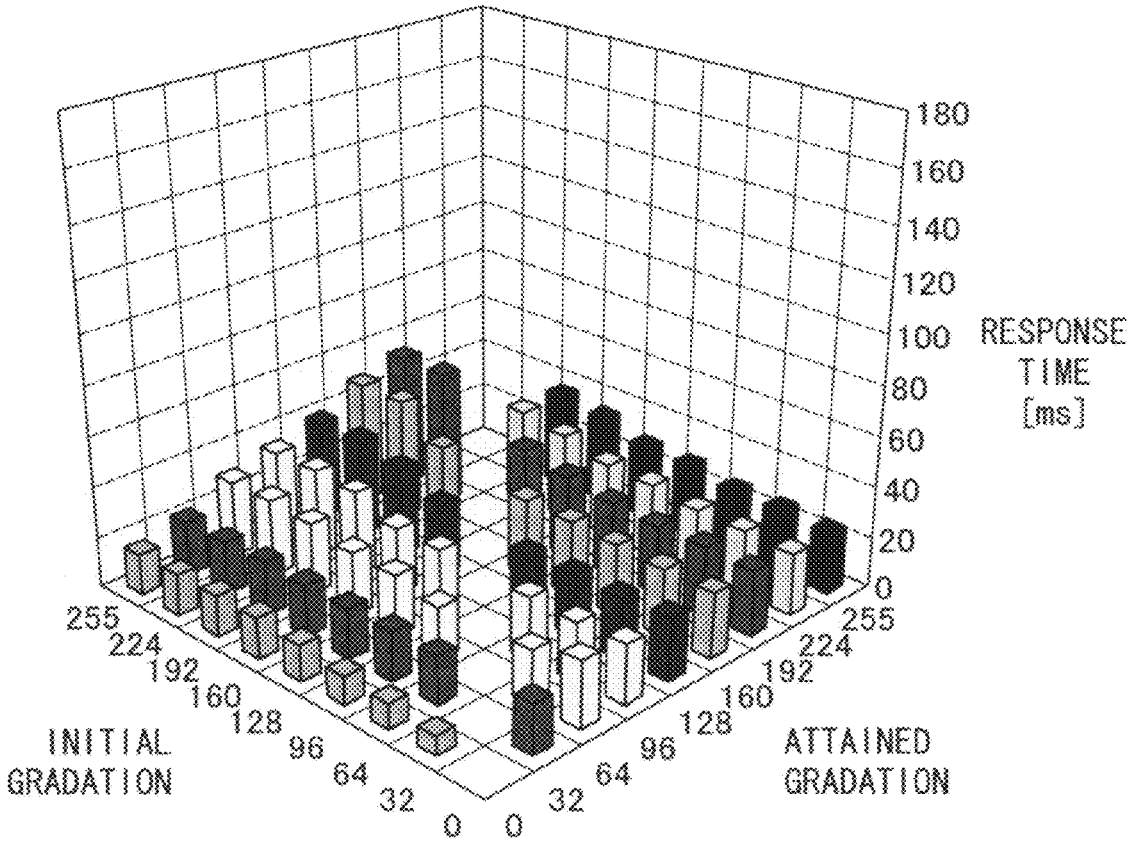
FIG. 8 is a three-dimensional graph showing a (V241 to V255→V240) response speed characteristic exhibited when a high-gradation region is eliminated at the time of displaying a moving image in the liquid crystal display apparatus according to a normally white system.
Figure 9:
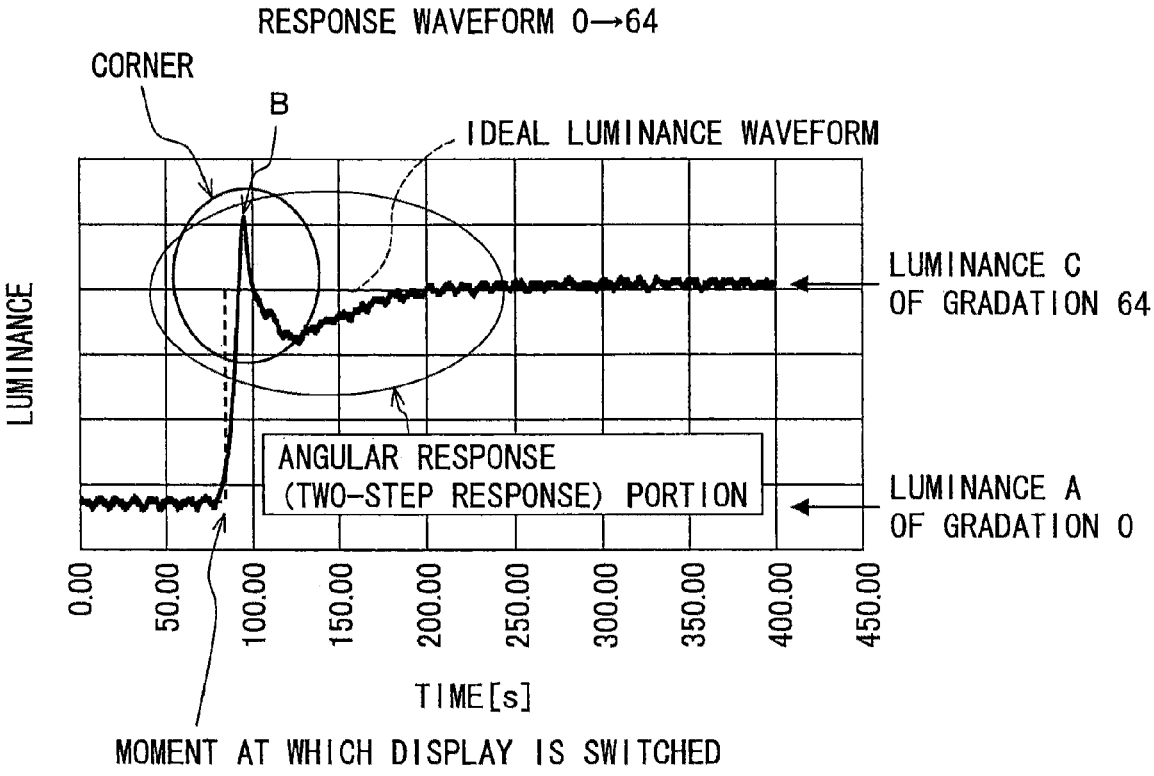
FIG. 9 shows a conventional method for driving a liquid crystal display apparatus, and is a waveform chart showing overdrive driving.
Figure 10:
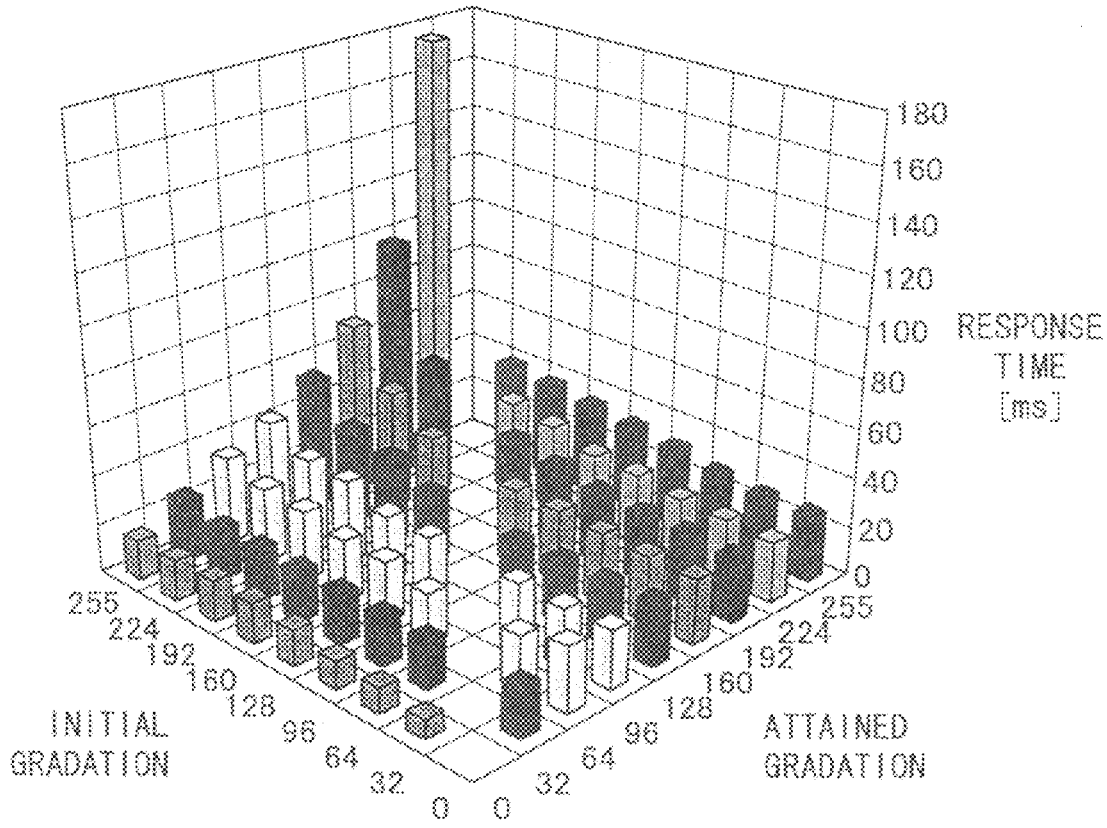
FIG. 10 is a three-dimensional graph showing a response speed characteristic exhibited when the liquid crystal display apparatus displays a moving image according to a normally white system.

Specifically, for example, in cases where the display section 1 having a total of 256 gradations is slow in responding to gradations V255 to V241, applied voltages respectively corresponding to the 15 gradations are raised to the same voltage as the gradation V240. This results in such a gradation-luminance relationship as shown in FIG. 7. Further, a comparison between FIG. 7 and FIG. 10 of the conventional technique shows that the response speed is improved in a transition from the initial gradation values 255 to 224 to the attained gradation values 255 to 224 or to the attained gradation values 224 to 192.

Further, in cases where the other gradations (V0 to V240) are not changed, the y characteristic of the display section 1 is not changed, so that it is possible to maintain a good display.

As described above, the method of the present embodiment for driving the liquid crystal display apparatus 10 is characterized as follows. That is, for example, in case of a normally black system, a low voltage can be applied as a gradation output when a still image is displayed. However, when a moving image is displayed, only a gradation that is higher by a predetermined voltage is used instead of that low voltage.

That is, a liquid crystal driving circuit generates an applied voltage corresponding to each gradation, but each gradation voltage is basically fixed. According to Japanese Unexamined Patent Application Publication No. 78129/2004 (Tokukai 2004-78129; published on Mar. 11, 2004), a gradation voltage is set in advance to be higher by a predetermined voltage. On the other hand, according to the present embodiment, a gradation voltage is set to be at the same level as a normal voltage, and a gradation of not more than a predetermined voltage is not used when a high-speed response is required. This makes it possible to easily realize a high-speed response. Further, when a high-speed response is not required, a gradation of not more than a predetermined voltage can be used. This makes it possible to carry out a display with higher contrast (with higher luminance in some cases).

Further, the application of the technique of the present embodiment to a conventional driving circuit as well as a liquid crystal display apparatus, having such a driving circuit, which carries out a display by using a portion of not less than a predetermined voltage makes it possible to realize a high-speed response without causing a change in the driving circuit.

Further, according the present embodiment, the response of the display section 1 to a moving image can be simply improved without needing a memory or a large-scale calculating circuit. This makes it possible to achieve a reduction in the number of parts, thereby achieving a reduction in cost of parts, in mounting area, and in mounting cost. For example, this function can be incorporated into a driving driver without causing an increase in the number of parts and in cost. Furthermore, it is not necessary to drive a memory or a calculating circuit. This makes it possible to achieve a reduction in power consumption.

Further, for gradations other than the gradations whose driving voltages have been uniformed, normal driving is performed. This results in a display with a good gradation γ characteristic.

Furthermore, a moving image and a still image are discriminated from each other in accordance with some sort of signal that represents a moving image or a still image, and in case of a still image, normal driving is performed for all the gradations. This makes it possible to carry out a display without impairing y characteristic, luminance, and contrast at all.

Further, an increase in power can be prevented by, at the time of displaying a still image, stopping driving a memory for overdrive, driving a calculating circuit, and supplying power to the memory.

As described above, the liquid crystal display apparatus 10 of the present embodiment is such that: when a still image is displayed, applied voltages respectively corresponding to a total of 256 types of gradation 0 to 255 are outputted to the pixels; on the other hand, when a moving image is displayed, an applied voltage corresponding to a predetermined gradation 32 is outputted to the pixels instead of applied voltages respectively corresponding to gradations of less than the predetermined gradation 32.

For this reason, normal gradations can be displayed when a still image is displayed. On the other hand, when a moving image is displayed, an applied voltage corresponding to a predetermined gradation 32 is outputted to the pixels instead of applied voltages respectively corresponding to gradations of less than the predetermined gradation 32. Therefore, the applied voltages respectively corresponding to the gradations of less than the predetermined gradation 32 are not used. This makes it possible to achieve an improvement in response speed.

Furthermore, since the applied voltages respectively corresponding to the gradations of less than the predetermined gradation 32 are not used, it is possible to prevent a so-called angular response, for example, in cases where overdrive driving is performed.

This makes it, possible to provide a method for driving a liquid crystal display apparatus 10, which method makes it possible to prevent deterioration in display quality of both a still image and a moving image and to achieve an improvement in response speed at which a moving image is displayed.

Further, according to the method of the present embodiment for driving the liquid crystal display apparatus 10, the liquid crystal display apparatus employs a normally black system, for example.

With this, since the response speed of a normally black system is low in a low-gradation region, the response speed can be improved.

Further, according to the method of the present embodiment for driving the liquid crystal display apparatus 10, it is preferable that when all the gradations consist of gradations 0 (black) to 255 (white) and the liquid crystal display apparatus employs a normally black system, the predetermined gradation m be defined as $1 \leqq m \leqq 32$.

This brings about an effect of improving the response speed of a normally black system when the predetermined gradation m is defined as $1 \leqq m \leqq 32$.

Further, according to the method of the present embodiment for driving the liquid crystal display apparatus 10, it is more preferable that when all the gradations consist of gradations 0 (black) to 255 (white) and the liquid crystal display apparatus employs a normally black system, the predetermined gradation m be defined as $9 \leqq m \leqq 15$.

This brings about an effect of improving the response speed of a normally black system when the predetermined gradation m is defined as $9 \leqq m \leqq 15$, and also achieves a reduction in deterioration of contrast and a reduction in influence of deterioration in image quality. For example, in case of a display whose gradation has a y characteristic adjusted to be 2.2 and whose initial contrast is not less than 200, a reduction in contrast at $9 \leqq m \leqq 15$ is kept to not more than 30%.

Further, according to the method of the present invention for driving the liquid crystal display apparatus, it is preferable that applied voltages respectively corresponding to predetermined gradations m to (n−1) for use in displaying a moving image be identical to still-image applied voltages respectively corresponding to predetermined gradations m to (n−1) for use in displaying a still image.

Specifically, according to the method of the present embodiment for driving the liquid crystal display apparatus 10, it is preferable that applied voltages respectively corresponding to predetermined gradations 32 to 255 be identical to still-image applied voltages respectively corresponding to predetermined gradations 32 to 255 for use in displaying a still image.

With this, as applied voltages respectively corresponding to predetermined gradations m (=32) to (n−1) (=255), still-image applied voltages respectively corresponding to predetermined gradations m (=32) to (n−1) (=255) for use in displaying a still image are used. This makes it possible to use a gradation-luminance characteristic that is exhibited when a still image is displayed, so that there is no change in display quality.

Further, a method of the present embodiment for driving a liquid crystal display apparatus 10 can be such that: when a still image is displayed, applied voltages respectively corresponding to a total of 256 types of gradation 0 to 255 are outputted to the pixels; on the other hand, when a moving image is displayed, an applied voltage corresponding to a predetermined gradation 240 is outputted to the pixels instead of applied voltages respectively corresponding to gradations of less than a predetermined gradation 241.

Further, according to the method of the present embodiment for driving the liquid crystal display apparatus 10, the liquid crystal display apparatus may employ a normally white system.

Further, according to the method of the present embodiment for driving the liquid crystal display apparatus 10, it is preferable that when all the gradations consist of gradations 0 (black) to 255 (white) and the liquid crystal display apparatus employs a normally white system, the predetermined gradation q be defined as $224 \leqq q \leqq 255$.

Further, according to the method of the present embodiment for driving the liquid crystal display apparatus 10, it is preferable that when all the gradations consist of gradations 0 (black) to 255 (white) and the liquid crystal display apparatus employs a normally white system, the predetermined gradation q be defined as $241 \leqq q \leqq 247$.

Further, according to the method of the present invention for driving the liquid crystal display apparatus, it is preferable that applied voltages respectively corresponding to predetermined gradations q−1 to 0 be identical to applied voltages respectively corresponding to predetermined gradations q−1 to 0 for use in displaying a still image.

Specifically, according to the method of the present embodiment for driving the liquid crystal display apparatus 10, it is preferable that applied voltages respectively corresponding to predetermined gradations 240 to 0 be identical to applied voltages respectively corresponding to predetermined gradations 240 to 0 for use in displaying a still image.

All this makes it possible to provide a method for driving a liquid crystal display apparatus 10, regardless of whether the liquid crystal display apparatus 10 employs a normally black system or a normally white system, which method makes it possible to prevent deterioration in display quality of both a still image and a moving image and to achieve an improvement in response speed at which a moving image is displayed.

Further, according to the method of the present embodiment for driving the liquid crystal display apparatus 10, it is preferable to discriminate between a still image and a moving image in accordance with a signal for discriminating between a still image and a moving image.

This makes it possible to provide a method for driving a liquid crystal display apparatus 10, which method makes it easy to discriminate between a still image and a moving image by acquiring a signal for discriminating between a still image and a moving image. When a still image is displayed, this method makes it possible to perform normal driving for all gradations, thereby making it possible to display the still image without impairing y characteristic, luminance, and contrast. When a moving image is displayed, this method makes it possible to achieve an improvement in response speed.

The embodiments and concrete examples of implementation discussed in the foregoing detailed explanation serve solely to illustrate the technical details of the present invention, which should not be narrowly interpreted within the limits of such embodiments and concrete examples, but rather may be applied in many variations within the spirit of the present invention, provided such variations do not exceed the scope of the patent claims set forth below.

INDUSTRIAL APPLICABILITY

The present invention can be used as a method for driving a liquid crystal display apparatus such as an active-matrix display.

The invention claimed is:

1. A method for driving a liquid crystal display apparatus, comprising the steps of:

when a still image is displayed, outputting applied voltages to pixels, the applied voltages respectively corresponding to a total of n (n being an integer of not less than 4) types of gradation 0 to (n−1); and when a moving image is displayed, outputting an applied voltage to the pixels instead of applied voltages respectively corresponding to gradations of less than a gradation m ($1 \leqq m \leqq (n-2)$), the applied voltage for the moving image being the applied voltage corresponding to the gradation m that is applied for the still image and outputting the applied voltages to the pixels respectively corresponding to gradations of between m and n−1 for the still image.

2. The method as set forth in claim 1, wherein the liquid crystal display apparatus employs a black system.

3. The method as set forth in claim 1, wherein when all the gradations consist of gradations 0 (black) to 255 (white) and the liquid crystal display apparatus employs a black system, the gradation m is defined as $1 \leqq m \leqq 32$.

4. The method as set forth in claim 1, wherein when all the gradations consist of gradations 0 (black) to 255 (white) and the liquid crystal display apparatus employs a black system, the gradation m is defined as $9 \leqq m \leqq 15$.

5. The method as set forth in claim 1, wherein applied voltages respectively corresponding to gradations m to (n−1) for use in displaying a moving image are identical to still-image applied voltages respectively corresponding to gradations m to (n−1) for use in displaying a still image.

6. The method as set forth in claim 1, comprising the step of discriminating between a still image and a moving image in accordance with a signal for discriminating between a still image and a moving image.

7. A method for driving a liquid crystal display apparatus, comprising the steps of:

when a still image is displayed, outputting applied voltages to pixels, the applied voltages respectively corresponding to a total of n (n being an integer of not less than 4) types of gradation 0 to (n−1); and when a moving image is displayed, outputting an applied voltage to the pixels instead of applied voltages respectively corresponding to gradations of not less than a gradation q ($2 \leqq q \leqq (n-1)$), the applied voltage for the moving image being the applied voltage corresponding to the gradation q-1 that is applied for the still image and outputting the applied voltages to the pixels respectively corresponding to gradations of between 2 and q−1 for the still image.

8. The method as set forth in claim 7, wherein the liquid crystal display apparatus employs a white system.

9. The method as set forth in claim 7, wherein when all the gradations consist of gradations 0 (black) to 255 (white) and the liquid crystal display apparatus employs a white system, the gradation q is defined as $224 \leqq q \leqq 255$.

10. The method as set forth in claim 6, wherein when all the gradations consist of gradations 0 (black) to 255 (white) and the liquid crystal display apparatus employs a white system, the gradation q is defined as $241 \leqq q \leqq 247$.

11. The method as set forth in claim 7, wherein applied voltages respectively corresponding to gradations 0 to q−1 for use in displaying a moving image are identical to applied voltages respectively corresponding to gradations 0 to q−1 for use in displaying a still image.

12. A method for driving a liquid crystal display apparatus, comprising the steps of:

when a still image is displayed, outputting applied voltages to pixels, the applied voltages respectively corresponding to a total of n (n being an integer of not less than 4) types of gradation 0 to (n−1); and when a moving image is displayed, outputting an applied voltage to the pixels instead of applied voltages respectively corresponding to gradations of less than a gradation m ($1 \leqq m \leqq (n-2)$), the applied voltage corresponding to the gradation m and being greater than zero and outputting the applied voltages to the pixels respectively corresponding to gradations of between m and n−1 for the still image.

* * * * *